US005594399A

United States Patent [19]

Blanchard et al.

[11] Patent Number: 5,594,399

[45] Date of Patent: Jan. 14, 1997

[54] PROTECTIVE SWITCHING DEVICE

[75] Inventors: Christian Blanchard, Singapore, Singapore; Michel Lauraire, Saint Maur Des Fosses; Didier Vigouroux, Jouy-Le-Moutier, both of France

[73] Assignee: Schneider Electric SA, Boulogne Billancourt, France

[21] Appl. No.: 394,243

[22] Filed: Feb. 24, 1995

[30] Foreign Application Priority Data

Feb. 25, 1994 [FR] France ..... 94 02308

[51] Int. Cl.[6] ..... H01H 67/02

[52] U.S. Cl. ..... 335/132; 335/202

[58] Field of Search ..... 335/132, 202

[56] References Cited

U.S. PATENT DOCUMENTS

| | | | |
|---|---|---|---|
| 5,218,332 | 6/1993 | Blanchard et al. | 335/132 |
| 5,296,826 | 5/1994 | Hart et al. | 335/132 |

FOREIGN PATENT DOCUMENTS

| | | |
|---|---|---|
| 0366519 | 5/1990 | European Pat. Off. . |
| 0369844 | 5/1990 | European Pat. Off. . |
| 0486389 | 5/1992 | European Pat. Off. . |
| 4123563 | 1/1992 | Germany . |

*Primary Examiner*—Lincoln Donovan
*Attorney, Agent, or Firm*—Oblon, Spivak, McClelland, Maier & Neustadt, P.C.

[57] ABSTRACT

A protective switching device equipped with power poles, for which mobile contacts are supported on a contact support, a protection assembly with magnetic and/or temperature tripping capable of detecting overloads or overcurrents on each pole current path and a lock operated by a manual control knob. The lock includes a mechanism to control direct opening of power contacts of a circuit breaker or similar device in a manual control, or opening of an auxiliary contact that interrupts the current in the coil in the control electromagnet of a contactor-circuit breaker or similar device.

7 Claims, 4 Drawing Sheets

PROTECTIVE SWITCHING DEVICE

BACKGROUND OF THE INVENTION

1. Field of the Invention

This invention concerns a protective switching device consisting of power poles with mobile and fixed contacts, a protection assembly with magnetic and/or temperature tripping and a lock that can be operated by a manual control knob.

2. Discussion of the Background

A circuit breaker-motor or manual starter contains a manual control function and a protection function, in a single housing. Temperature and magnetic tripping devices for each phase act on a common lock. If there is an electrical fault on one of the poles, the magnetic and/or temperature tripping assembly that performs the protection function will make the contacts open. This assembly acts on contacts through the lock which can also be actuated manually using a manual control knob.

A contactor-circuit breaker performs a contactor function and a circuit breaker function. It incorporates manual control devices, a magnetic and/or temperature tripping device and a normal automatic control electromagnet to move the contacts. The circuit breaker-motor or manual starter mentioned above have similar devices for moving the contacts, but has no electromagnet.

SUMMARY OF THE INVENTION

The purpose of this invention is to provide a lock that can indifferently be installed in a contactor-circuit breaker, a circuit breaker-motor or a manual starter.

The device according to the invention is characterized by the fact that the lock contains means for manually controlling either direct opening of the power contacts of a circuit breaker-motor, or opening of an auxiliary contact that interrupts the current in the coil of a control electromagnet in a contactor-circuit breaker.

According to one characteristic, the lock comprises a tripping device stage mounted on a plate and actuated by the protection assembly, and a motor stage mounted on a plate and activating mobile contacts, these two stages being superimposed.

BRIEF DESCRIPTION OF THE DRAWINGS

The invention will now be described in more detail, referring to construction methods given as an example and represented in the drawings shown in the Appendix, in which.

DESCRIPTION OF THE PREFERRED EMBODIMENTS

Figure 1:
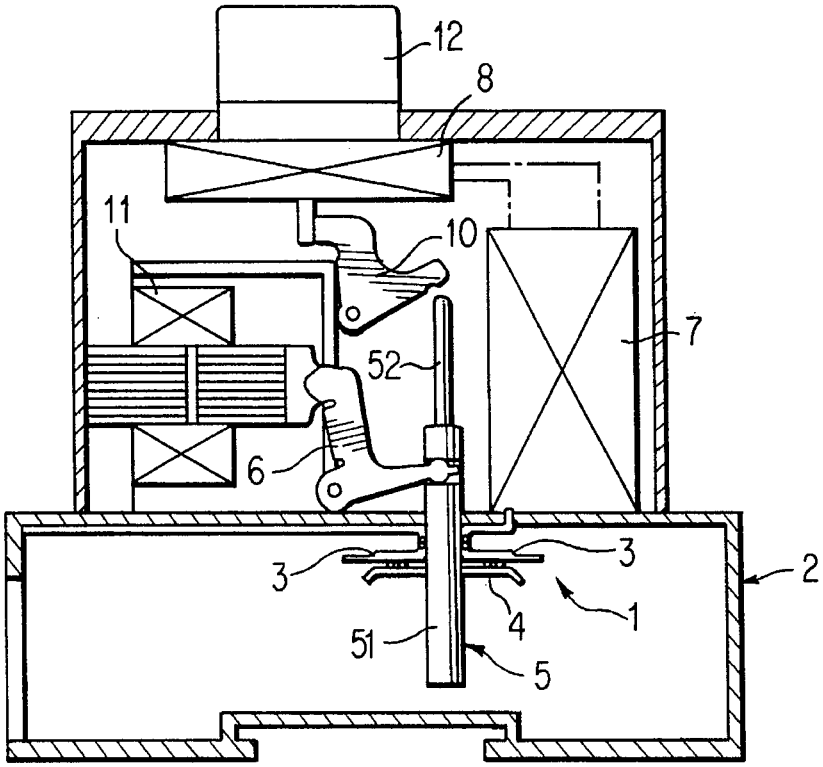
FIG. 1 is a schematic of a contactor-circuit breaker equipped with the lock according to the invention.
Figure 2:
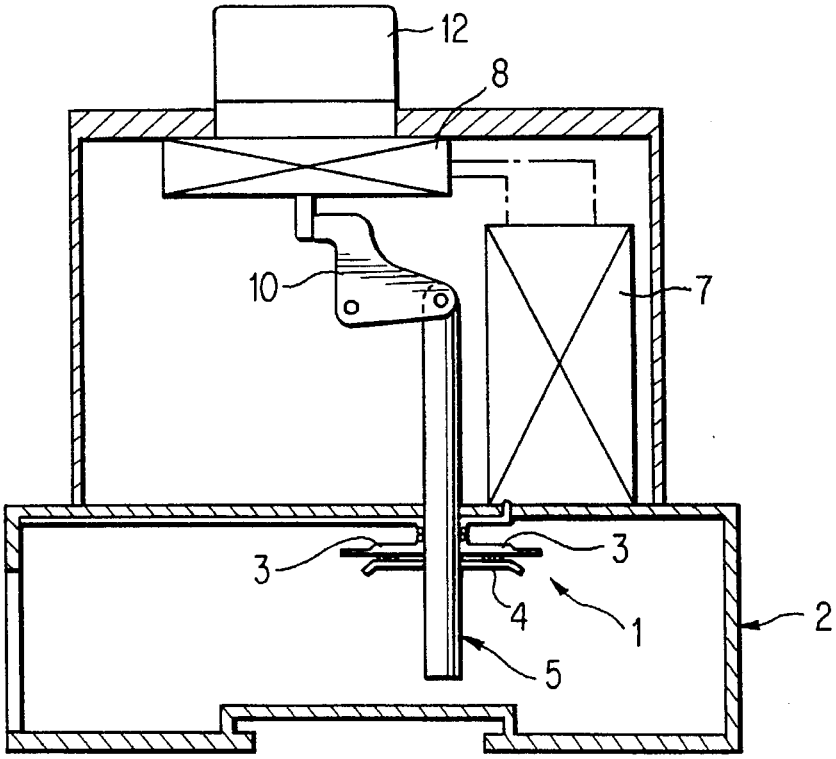
FIG. 2 is a schematic of a circuit breaker-motor or manual starter equipped with the lock according to the invention.
Figure 3:
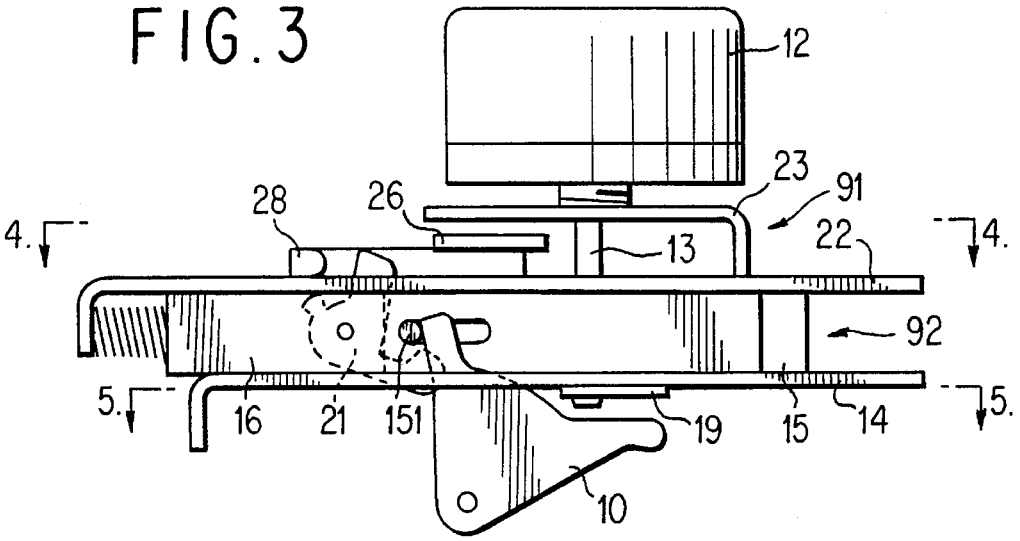
FIG. 3 is an elevational view of the lock.
Figure 4:
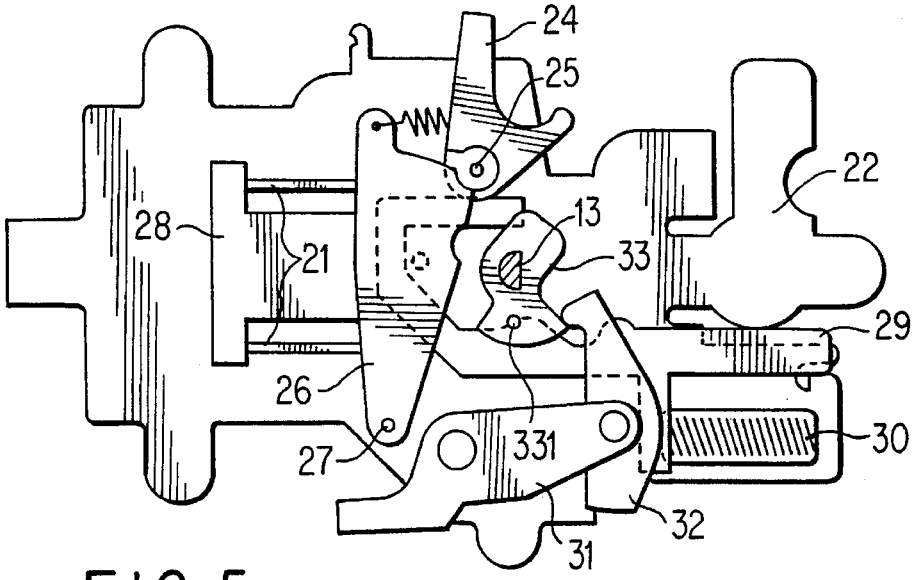
FIG. 4 is a sectional view taken along line 4—4 in FIG. 3 (lock trigger device stage)
Figure 5:
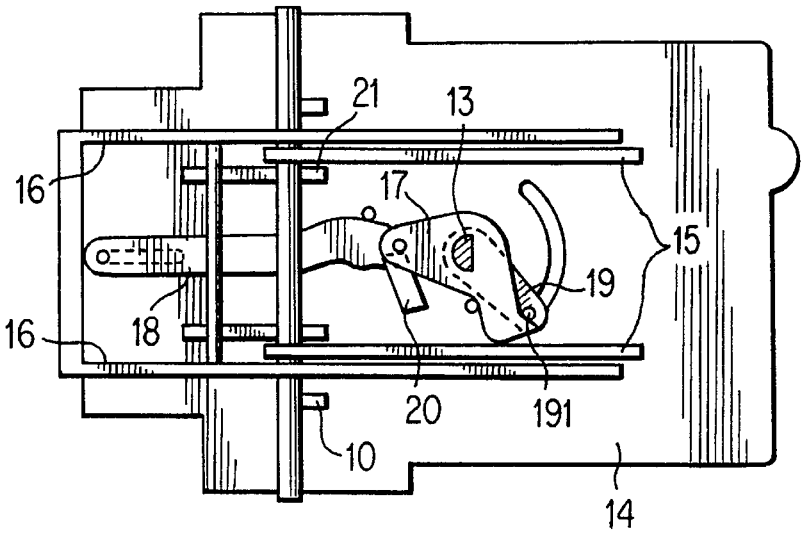
FIG. 5 is a sectional view taken along line 5—5 in FIG. 3 (lock motor stage)

The control mechanism according to the invention is designed to be used in a contactor-circuit breaker type of protective switch device such as that shown in FIG. 1, or a manual starter type or a circuit breaker-motor type such as that shown in FIG. 2.

This device will include power poles 1 capable of breaking the current on current paths terminating at connection terminals used for the connection. A single double-break type pole 1 is shown on FIGS. 1 and 2 in order to simplify the drawings.

For each pole 1, conductors 3 connect connection terminals to fixed contacts, the associated mobile contacts being supported by a mobile contacts bridge 4. This mobile contacts bridge 4 co-operates with the fixed contacts to make or break current flows passing between connection terminals.

A contact support assembly 5 supporting contact bridges 4 slides in casing 2, perpendicular to the plane passing through the fixed contacts.

A protection assembly 7 with magnetic and/or temperature tripping is housed in the casing, to detect overloads or overcurrents on each current path associated with a pole. When this protection assembly 7 detects an overcurrent or overvoltage on a current path, it controls opening of the mobile contacts through a lock 8 and linkage plate 10.

In the contactor-circuit breaker illustrated in FIG. 1, the contact support assembly 5 includes a sliding support 51 and slides 52 guided in this sliding support and each capable of moving a contacts bridge 4 in translation. A contacts pressure spring tends to move each contact bridge 4 relative to support 51, in the direction of closing the contacts. The linkage plate 10 is capable of moving the slides 52.

An electromagnet 11 is housed in casing 2 to move the contact support 5. This electromagnet includes a fixed magnetic circuit, a mobile armature and a coil electrically connected to terminals by separable contacts, also referred to as coil contacts. These contacts may be moved by lock 8, or by manually turning the control knob 12, or if there is a fault, by the protection assembly 7. A return spring acts on the mobile armature in the electromagnet and moves a return rocker lever 6 which is directly connected to support 51. The contact support assembly 5 is therefore acted upon by the electromagnet return spring. If the coil is no longer excited, the return spring moves the mobile armature, which acts on the return rocker lever 6 to move the contact support 5 to the open position (contacts open).

In the circuit breaker-motor shown in FIG. 2, the linkage plate 10 is linked to the upper end of the contact support 5 through a hinge, in order to drive this contact support either in the opening direction or in the closing direction.

Lock 8 which is shown in detail in FIGS. 3 to 10, includes means to displace the linkage plate 10 in the manual starter version or to control electromagnet coil contacts in the contactor-circuit breaker version. It comprises a tripping device stage 91 mounted on a plate 22 and a motor stage 92 mounted on a plate 14, these two stages being superimposed. The tripping device stage 91 is activated by manual control knob 12 and protection assembly 7, whereas motor stage 92 activates the mobile contacts.

Lock 8 is activated the manual mode by the manual control knob 12 located on the front of the casing. This manual control knob 12 turns a rotary main shaft 13 which is guided in rotation in the lock and can be pivoted into three main positions, namely an "on" position (contacts closed), an "off" position (contacts open) or an intermediate "tripped" position (contacts open on fault).

The motor stage 92 (FIG. 5) is installed between the lower plate 14 and the intermediate plate 22 which are practically parallel. It contains a slide or carriage-striker 15 used to activate the linkage plate 10 and a slide or reset carriage 16, both guided in translation on the lower plate 14 so as to slide along an axis. The reset carriage 16 is equipped with a pivoting hook 21 that can be coupled to the carriage-striker 15 or release the carriage-striker 15. This hook is acted upon by a spring (not shown) which tends to bring it back into the hooked position.

The carriage-striker 15 is acted upon by a spring, not shown, that tends to move it away from the reset carriage 16 when the hook 21 is released and to move it from the "on" or "off" position to the "tripped" position. As it moves, the carriage-striker 15 pivots the linkage plate 10.

A reset handle 17, which rotates freely about the main shaft 13, is connected to a reset rod 18 through a hinge, to form a toggle fastener. When the toggle fastener is unfolded, the end of rod 18 can immobilize the reset carriage 16 in the "on" or "off" position.

The knob 12 rotates a reset lever 19 which pivots about axis 13, and pivots the reset handle 17 through a pin 191. It is also attached to a cam 33 which acts on a sliding tripping part 29 (in the circuit breaker-motor) and on a coil contact (in the contactor-circuit breaker) version. The cam 33 acts on the clutch engagement part 29 through a pin 331. It activates the coil contact through levers 32 and 31. It also resets the tripping device stage 91.

A locking part 20 can slide with respect to plate 14. It can immobilize the articulated lever 18–19 in the "on" or "off" position. It controls sudden closure by holding linkage plate 10 in the open position until the articulated lever has returned to the "on" position.

In the manual starter version, the tripping device part 29 controls movement from the "on" to the "off" position. It acts directly on hook 21 through the drive part 28. When knob 12 is rotated, this engagement part 29 is moved by pin 331.

Tripping device stage 91 (FIG. 4) is installed on top of the motor stage 92, between the intermediate plate 22 and an upper plate 23.

This tripping device stage 91 moves a tripping lever 26, which pivots about a pin 27. This tripping lever 26 is fixed in the on-off position (FIG. 6) by a tripping cleat 24 which can be rotated by the protection assembly 7. After being released by cleat 24, the tripping device lever 26 which is acted upon by a spring (not shown) can rotate and move into the "tripped" position, pivoting hook 21 through a drive part 28. The cleat 24 is also acted upon by a spring (not shown).

We will now explain operation of the lock in a contactor-circuit breaker, referring particularly to FIGS. 4 to 8.

Figure 6:
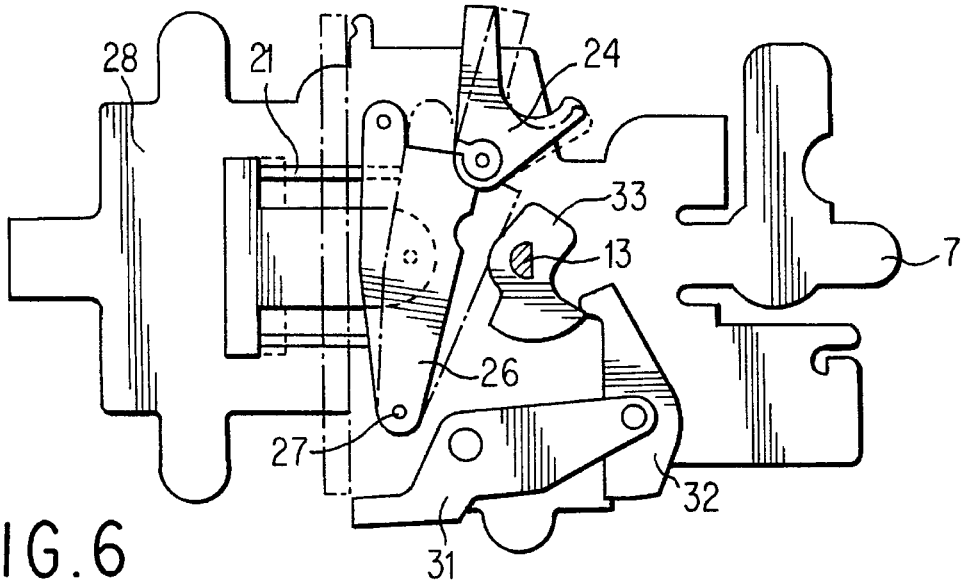
FIG. 6 shows the lock tripping device stage in various positions ("off", "on", "tripped")
Figure 7:
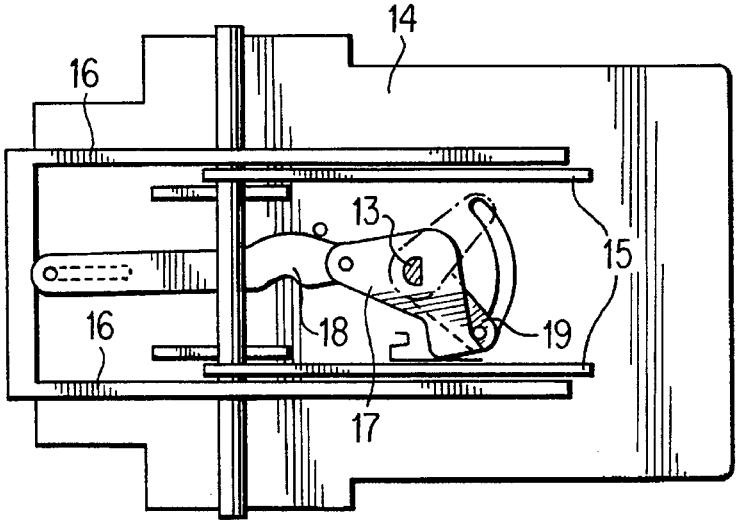
FIG. 7 shows the motor stage of the lock for the contactor-circuit breaker version, in the "on" and "off" positions.

In the "stop" position marked A in FIGS. 6 and 7, the carriage-striker 15 is attached to the reset carriage 16. The articulated lever 17–18 which is unfolded, now holds the reset carriage in the "on" position. The coil contact is open.

When he wants to change from the "off" to the "on" position, the operator rotates knob 12 from "off" to "on". During this rotation, cam 33 which rotates with spindle 13, activates the coil contact through levers 32 and 31, thus closing the contacts. The electromagnet 11 which is then energized displaces the contact support 5 (contact closure).

The reverse procedure is used to change from "on" to "off".

Figure 8:
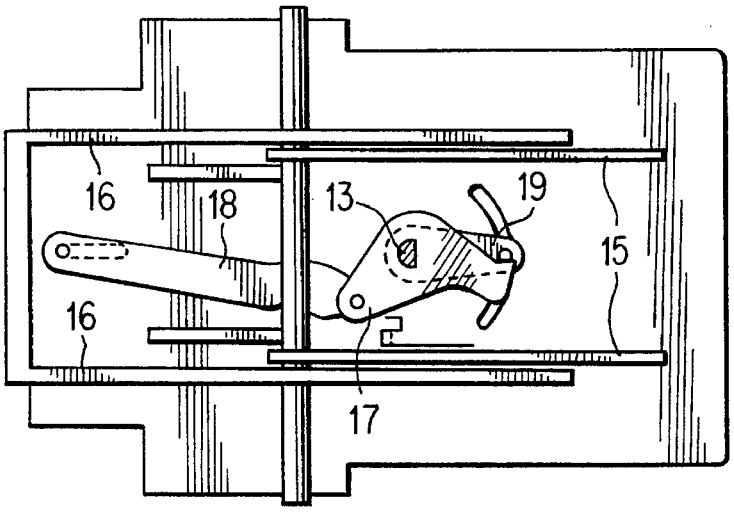
FIG. 8 shows the lock motor stage for the contactor-circuit breaker version, in the "tripped" position.
Figure 9:
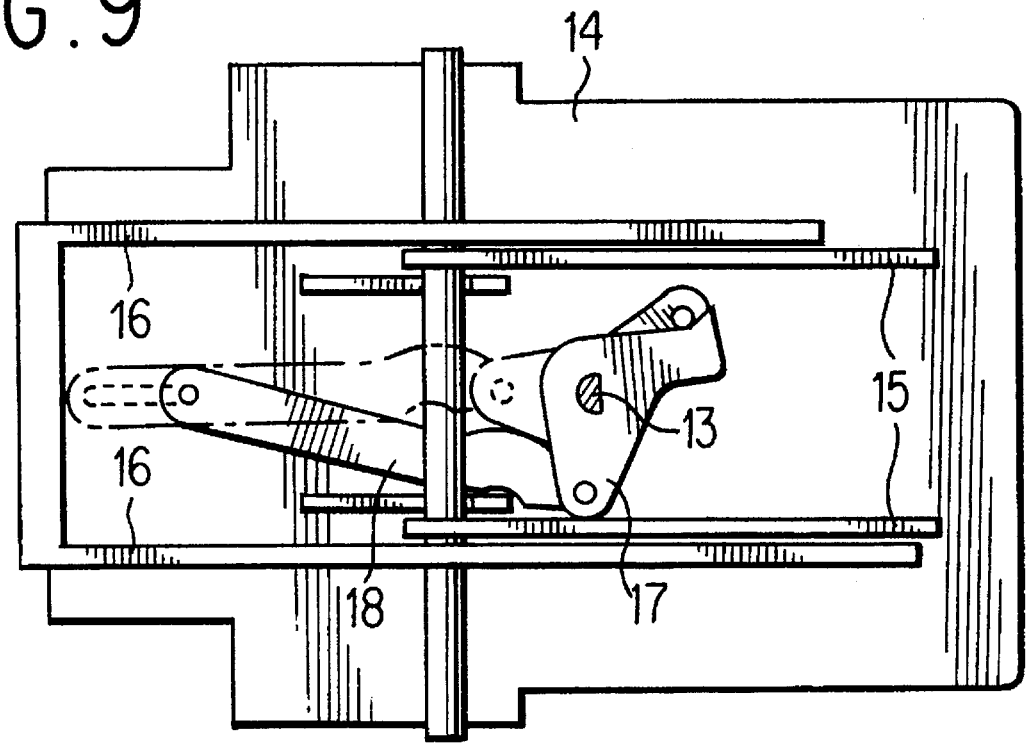
FIG. 9 represents the lock motor stage for the starter version, in the "on" and "off" positions.
Figure 10:
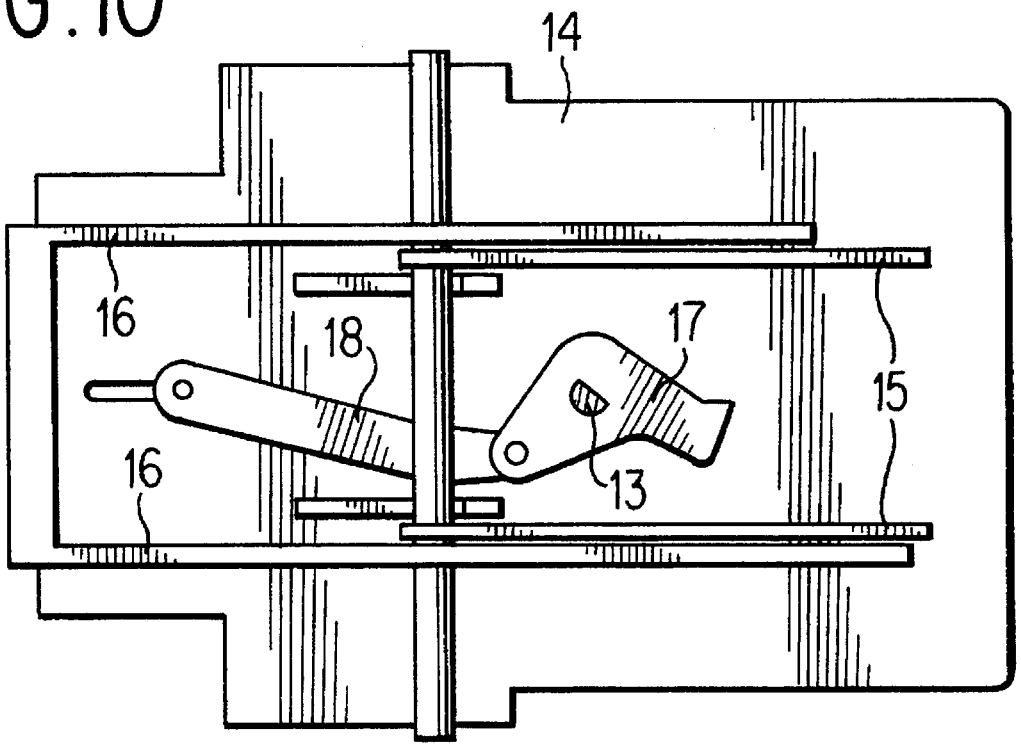
FIG. 10 represents the lock motor stage for the starter version, in the "tripped" position.

If there is a fault (overload or short circuit), a tripping order from the magnetic or temperature tripping device 7 is applied to cleat 24. The cleat pivots and releases the trip lever 26 which pivots hook 21 through drive part 28. As it rotates, hook 21 releases the carriage-striker 15 which translates under the effect of the spring acting upon it. The carriage-striker 15 moves linkage plate 10 and slides 52. The articulated lever 7–8 folds, the reset lever 19 pivots and rotates knob 12 (FIG. 8). Levers 31–32 move the coil contact, switching off the power supply to the coil. Electromagnet 11 is thus released.

Reset carriage 16 is released because articulated lever 17–18 is folded. It can then move and fetch the carriage-striker 15. At the end of its travel, hook 21 fastens onto the carriage-striker 15.

To change from "tripped" to "off", the operator rotates knob 12 thus pivoting the reset lever 19 into the "off" position shown in chain dotted lines in FIG. 7. The reset carriage 16 can finish its travel to accompany the carriage-striker 15. Knob 12 rotates, thus rotating cam 33 that pivots the tripping device lever 26 so as to reset it on cleat 24. The contacts are still open. The linkage plate 10 is held in place by locking part 20, to perform the sudden closure.

All springs are reset, to change from "off" to "on" (reset after fault). Use reset lever 19 and its pin to reset articulated lever 17–18 and the two carriages return to the "on" position.

Note in this case that the tripping device part 29 is inoperative.

We will now describe operation of the locking mechanism in a circuit breaker-motor, referring particularly to FIGS. 4, 5, 9 and 10.

Tripping takes place in the same way as in the previous case.

The reset carriage 16 is reset using articulated lever 17–18. The tripping device part 29 controls tripping. It acts on hook 21.

Note that the coil contact is inoperative in this version.

The lock that has just been described forces contacts open.

Obiviously, alternatives and improvements to details could be imagined without going outside the framework of the invention, and it would even be possible to use equivalent means.

We claim:

1. Protective switching device which comprises:

power poles having mobile contacts supported on a contact support, a protection assembly having one of a magnetic and a temperature tripping mechanism detecting one of an overload and an overcurrent on each pole current path;

a lock operated by a manual control knob wherein the lock includes a control mechanism controlling one of direct opening of power contacts of a circuit breaker-motor in manual control, and opening of an auxiliary contact interrupting the current in a coil in a control electromagnet of a contactor-circuit breaker wherein the lock comprises a tripping device stage mounted on a plate acted upon by a manual control knob and the protection assembly and a motor stage installed on a plate and activating the mobile contacts, said tripping device stage and motor stage being superimposed; and a main shaft and a reset rod wherein the motor stage includes a reset handle which rotates freely about said main shaft and is hinged to said reset rod, said reset handle locking the reset carriage in an "on" or "off" position.

2. Device according to claim 1, wherein the motor stage comprises a carriage-striker activating the contact support and a reset carriage, both guided in translation, the reset carriage being one of coupled to the carriage-striker and releasing the said carriage-striker.

3. Device according to claim 1, wherein the lock comprises a tripping part moved by said knob and acting directly on a hook.

4. Device according to claim 1, wherein the knob is fixed in rotation to a reset lever pivoting the reset handle as said reset handle pivots around the spindle of the knob.

5. Device according to claim 1, wherein the manual control knob is fixed in rotation to a cam which acts on one of a tripping part in the circuit breaker-motor, and on the coil contact in the contractor-circuit breaker resets the tripping device stage.

6. Device according to claim 1, wherein the lock comprises a slidable locking part for locking the articulated lever in the "off" or "on" position and causes sudden closure by holding the contact support in the open position until the articulated lever has returned to the "on" position.

7. Device according to claims 1 or 3, wherein the: tripping device stage comprises a tripping lever that is fixed in the "on" or "off" position and is releasable by a protection assembly to return to a "tripped" position and release the carriage-motor.

* * * * *